US012467340B2

(12) United States Patent
Quin et al.

(10) Patent No.: US 12,467,340 B2
(45) Date of Patent: Nov. 11, 2025

(54) METHOD AND SYSTEM FOR POWER GENERATION

(71) Applicant: Cameron International Corporation, Houston, TX (US)

(72) Inventors: David Quin, Longford (IE); Edmund Peter McHugh, Longford (IE); Michael Mullin, Longford (IE)

(73) Assignee: Cameron Internation Corporation, Houston, TX (US)

( * ) Notice: Subject to any disclaimer, the term of this patent is extended or adjusted under 35 U.S.C. 154(b) by 0 days.

(21) Appl. No.: 18/840,138

(22) PCT Filed: May 11, 2023

(86) PCT No.: PCT/US2023/021904

§ 371 (c)(1),
(2) Date: Aug. 21, 2024

(87) PCT Pub. No.: WO2023/220286

PCT Pub. Date: Nov. 16, 2023

(65) Prior Publication Data

US 2025/0163898 A1 May 22, 2025

Related U.S. Application Data

(60) Provisional application No. 63/364,525, filed on May 11, 2022.

(51) Int. Cl.
*E21B 41/00* (2006.01)

(52) U.S. Cl.
CPC ..... *E21B 41/0085* (2013.01)

(58) Field of Classification Search
CPC .... E21B 41/0085; F03G 7/04; F05B 2210/13; F05B 2240/242; F05B 2270/506
See application file for complete search history.

(56) References Cited

U.S. PATENT DOCUMENTS

| | | | | |
|---|---|---|---|---|
| 3,758,235 | A | 9/1973 | Breeden | |
| 4,654,061 | A * | 3/1987 | Jung | F03G 7/04 55/447 |
| 4,654,537 | A | 3/1987 | Gaspard | |
| 4,809,510 | A | 3/1989 | Gaspard | |
| 5,117,908 | A | 6/1992 | Hofmann | |
| 5,149,984 | A | 9/1992 | Schultz | |
| 8,680,704 | B1 | 3/2014 | Rooney | |
| 9,476,427 | B2 | 10/2016 | Torkildsen | |

(Continued)

*Primary Examiner* — Brad Harcourt
(74) *Attorney, Agent, or Firm* — Jeffrey D. Frantz

(57) ABSTRACT

A system for generating electrical power may include a flowline having an inlet that receives reservoir fluid at a first pressure, an outlet that outputs the reservoir fluid at a second pressure, a first flow path between the inlet and the outlet, and a second flow path between the inlet and the outlet, in parallel with the first flow path. The difference between the first pressure and the second pressure may include a pressure differential, and the system may include a valve that adjusts the pressure differential. Additionally, the system may include a turbine disposed along the second flow path that generates mechanical energy from a flow of the reservoir fluid induced by the pressure differential, and the mechanical energy may be converted to electrical energy.

14 Claims, 8 Drawing Sheets

(56) References Cited

U.S. PATENT DOCUMENTS

| | | | | |
|---|---|---|---|---|
| 10,458,206 | B2 * | 10/2019 | Al-Dossary | E21B 47/06 |
| 2017/0284219 | A1 * | 10/2017 | Hunter | F03B 13/00 |
| 2017/0306725 | A1 | 10/2017 | Hunter | |
| 2018/0106138 | A1 | 4/2018 | Randolph | |
| 2019/0010783 | A1 | 1/2019 | Frosell | |
| 2020/0040676 | A1 | 2/2020 | Greci | |
| 2020/0392815 | A1 * | 12/2020 | Clark | F01K 25/08 |
| 2022/0282695 | A1 * | 9/2022 | Peviani | E21B 43/38 |
| 2023/0323851 | A1 * | 10/2023 | Holland | E21B 41/0085 166/244.1 |
| 2024/0263547 | A1 * | 8/2024 | Torkildsen | E21B 43/121 |

* cited by examiner

METHOD AND SYSTEM FOR POWER GENERATION

CROSS-REFERENCE TO RELATED APPLICATION

This application is a non-provisional application claiming priority to and the benefit of U.S. provisional application No. 63/364,525, entitled "METHOD AND SYSTEM FOR POWER GENERATION," filed May 11, 2022, which is hereby incorporated by reference in its entirety for all purposes.

BACKGROUND

The present disclosure generally relates to systems and methods for generating electrical power. More specifically, electrical power may be generated by harnessing a pressure differential in the flow of oil, gas, and/or other reservoir fluids retrieved via a well to power wellsite operations and/or for export.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

As natural resources are extracted from reservoirs via wells, the extracted hydrocarbons may be transported to various types of equipment, tanks, processing facilities, and the like via transport vehicles, a network of pipelines, etc. For example, hydrocarbons such as oil and natural gas may be extracted from the reservoirs via hydrocarbon wells and then be transported, via the network of pipelines, to various processing stations that perform various phases of hydrocarbon processing to make the produced hydrocarbons available for use or further transport.

In some scenarios, the pressure of the hydrocarbons within the pipelines, such as output from a well, may be higher than necessary or too high for effective/viable transportation and/or too high for input to one or more processing systems. As such, at one or more locations along the pipeline(s), the pressure of the hydrocarbons may be reduced, such as via a choke valve, to allow for handling and/or processing of the hydrocarbons. In some scenarios, heat may be added (e.g., via a heating element) to offset the cooling effect (e.g., Joules Thompson (JT) effect) associated with reducing the pressure of a gas. Alternatively, active cooling may be needed to offset heat from the friction associated with certain methods of reducing the pressure. As such, reducing the pressure may entail an energy input.

In some instances, the potential energy of the pressurized hydrocarbons prior to the choke or other pressure reducing device may be large enough to harness for use. Thus, it may be beneficial to harness the potential energy associated with the pressure differential between the higher and lower pressure sections of the pipeline.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a system for generating electrical power may include a flowline having an inlet that receives reservoir fluid at a first pressure, an outlet that outputs the reservoir fluid at a second pressure, a first flow path between the inlet and the outlet, and a second flow path between the inlet and the outlet, in parallel with the first flow path. The difference between the first pressure and the second pressure may include a pressure differential, and the system may include a valve that adjusts the pressure differential. Additionally, the system may include a turbine disposed along the second flow path that generates mechanical energy from a flow of the reservoir fluid induced by the pressure differential, and the mechanical energy may be converted to electrical energy.

In another embodiment, a method may include receiving, at an inlet of a flowline, a reservoir fluid from a well of a geological formation. The flowline may include a first flow path between the inlet and an outlet of the flowline and a second flow path between the inlet and the outlet, in parallel with the first flow path. Additionally, the method may include regulating, via a choke valve disposed in the first flow path, a pressure differential of the reservoir fluid between the inlet and the outlet and generating, via a turbine disposed in the second flow path, power, based on a flow of the reservoir fluid, induced by the pressure differential, through the turbine.

In another embodiment, a system may include a flowline having an inlet, an outlet, a first flow path between the inlet and the outlet, and a second flow path between the inlet and the outlet, in parallel with the first flow path. The flowline may receive, at the inlet, a hydrocarbon fluid at a first pressure from a well in a geological formation and output, at the outlet, the hydrocarbon fluid at a second pressure, such that a difference between the first pressure and the second pressure comprises a pressure differential. Additionally, the system may include a turbine having a rotor disposed in the second flow path, where the rotor rotates based on a flow of the hydrocarbon fluid through the second flow path that is induced by the pressure differential. Moreover, the system may include a choke valve disposed on the first flow path to regulate the pressure differential.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
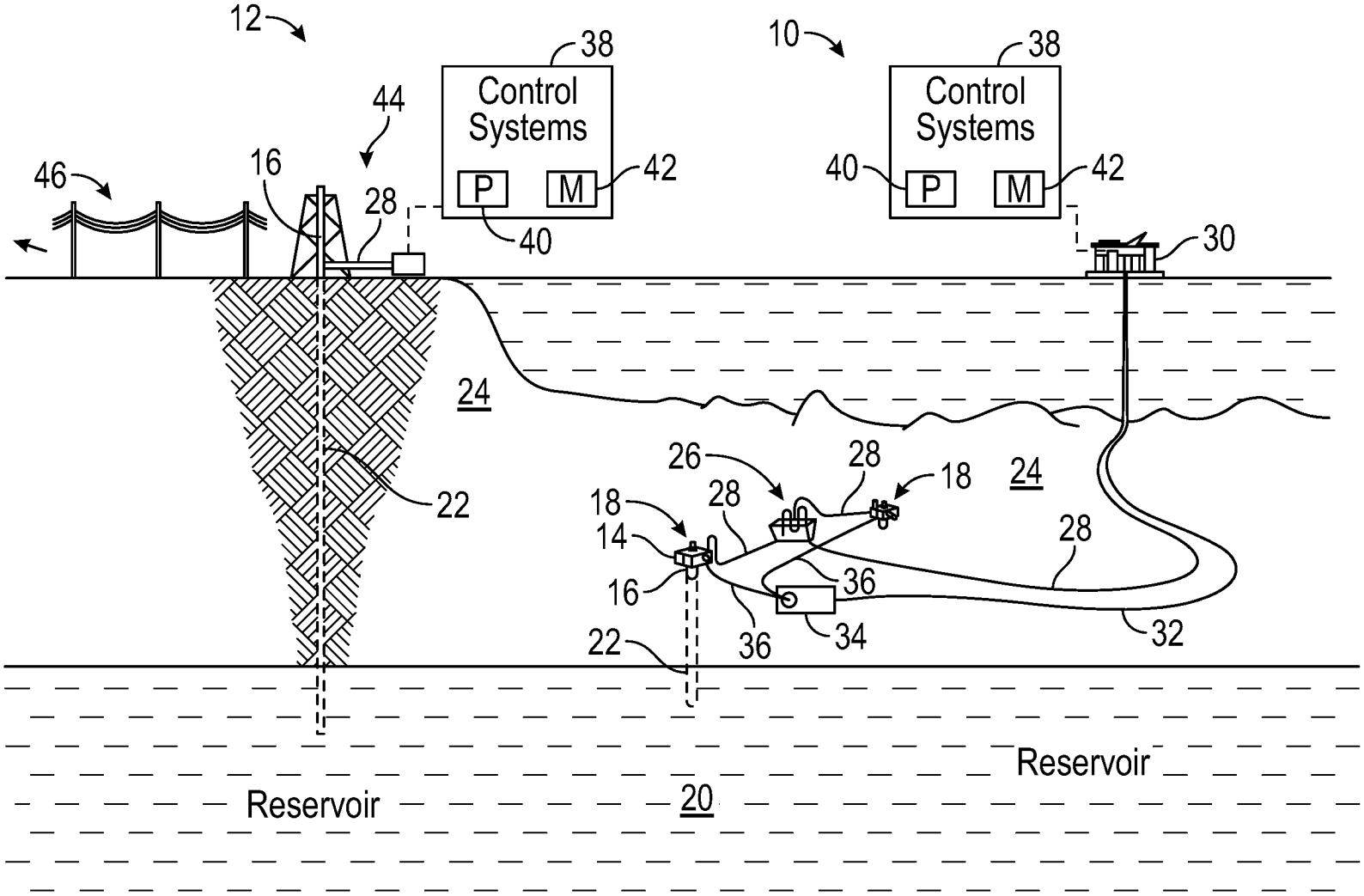
FIG. 1 is a schematic view of a land-based production system and a subsea production system, according to an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Reservoir fluids, such as oil, natural gas, other hydrocarbons, etc., may be obtained from subterranean or subsea geologic formations, often referred to as reservoirs, by drilling one or more wells that penetrate the into the geologic formation. In subsea applications, various types of infrastructure may be positioned underwater and/or along a sea floor to aid in retrieving the hydrocarbon fluids. In both land-based and subsea applications, extracted reservoir fluids may be transported (e.g., via one or more pipelines) from the well(s) to various types of equipment, tanks, processing facilities, and the like.

In some scenarios, the pressure of the reservoir fluid, in liquid, gas, or mixed state, within the pipelines, such as output from a well may be higher than necessary or too high for effective transportation and/or for input to one or more processing systems. As such, at one or more locations along a flowline (e.g., pipeline) from a well, the pressure of the reservoir fluid be reduced, such as via a choke valve, to allow for handling and/or processing of the reservoir fluid. For example, a choke valve may reduce the pressure of an oil and gas mixture to facilitate usage of more cost-effective materials (e.g., lower pressure piping) and/or reduce the pressure of the oil and gas mixture to within an operating range of an oil and gas processing system. As such, a pressure differential may be created or already exist between different portions (e.g., before and after a choke valve) of the flowline.

In some embodiments, a turbine such as a turboexpander may utilize the pressure differential to generate electrical power. For example, a primary flow path of the reservoir fluid from a well to one or more processing systems may include a choke valve or other pressure reducing device, and a parallel flow path (e.g., parallel to the primary flow path and bypassing the choke valve) may include a turbine that converts the potential energy of the pressure differential to mechanical energy. Moreover, the turbine may be coupled to or integrated with a generator to produce electrical power from the mechanical energy of the turbine.

Additionally, as the reservoir fluid is provided from a well, the reservoir fluid may be an unprocessed (e.g., raw) liquid, gas, or liquid-gas mixture that also contains particulate matter (e.g., rocks, sand, etc.). However, such particulate matter may cause erosion or other damage to the turbine over time. As such, in some scenarios, the reservoir fluid may be processed, at least in part, by a separator (e.g., debris separator and/or state separator). In some embodiments, the separator may reduce or eliminate particulate matter from the reservoir fluid without changing the state (e.g., liquid, gas, or mixture thereof) of the reservoir fluid, such that the state of the reservoir fluid through the turbine is the same as that output from the well. Additionally or alternatively, the separator may separate, at least partially, a gas flow of the reservoir fluid from a liquid flow of the reservoir fluid and the gas flow, the liquid flow, or both (e.g., via two parallel turbines) may be utilized to generate power via a turbine. Furthermore, as discussed further below, with or without the separator, the turbine may be utilized with one or more erosion resistance techniques to increase the longevity of the turbine.

Additionally, while the turbine provides power generation when the pressure differential is higher than needed or otherwise desired, in some embodiments, the turbine may be operated in a different mode or configuration to provide compression to the reservoir fluid if it is desired to increase the pressure differential. In other words, the turbine may operate in a power generation mode or a compressor mode depending on circumstance.

With the foregoing in mind, FIG. 1 is a schematic view of a subsea production system 10 and a land-based production system 12 for extracting a reservoir fluid, according to an embodiment of the present disclosure. As should be appreciated, both the subsea production system 10 and land-based production system 12 (generalized herein as production system 10, 12) are provided as example production systems, and may be implemented separately or in conjunction with one another. Moreover, the techniques disclosed herein may be applicable to either production system 10, 12.

In some embodiments, the subsea production system 10 may include a subsea tree 14 coupled to a wellhead 16 to form a subsea station 18 that extracts formation fluid, such as oil and/or natural gas, in a reservoir 20 via a well 22 drilled into a geological formation 24 (e.g., ocean floor, ground, etc.). As should be appreciated, the subsea production system 10 may include multiple subsea stations 18 that extract formation fluid from respective wells 22. In some embodiments, the formation fluid is directed from the subsea tree(s) 14 to a pipeline manifold 26 via one or more flowlines 28, and the pipeline manifold 26 may connect (e.g., via one or more flowlines 28) to a surface platform 30. In some embodiments, the surface platform 30 may include a floating production, storage, and offloading unit (FPSO) or a shore-based facility. Moreover, in some embodiments, the surface platform 30 may be an offshore production platform having one or more wells 22 extending therefrom through the water and into the geological formation 24. In addition to flowlines 28 that carry the formation fluid away from the wells 22, the subsea production system 10 may include lines or conduits 32 that supply fluids, as well as carry control and data lines to the subsea equipment. These conduits 32 may connect to a distribution module 34, which in turn couples to the subsea stations 18 via supply lines 36.

Control and monitoring of the subsea conditions and operations, as well as those on the surface platform 30 may be performed via one or more controllers or control systems 38, including one or more processors 40 and memory 42. The control system(s) 38 may be disposed at one or more subsea locations, on the surface platform, or a combination thereof. As should be appreciated, the processor(s) 40 may execute instructions stored in memory 42 to perform control and/or monitoring functions. Moreover, the memory 42 may be any suitable article of manufacture that can store the instructions. For example, the memory 42 may be read-only memory (ROM), random-access memory (RAM), flash memory, an optical storage medium, or a hard disk drive, to name a few examples. Furthermore, the processor(s) may include any suitable computing circuitry such as general-purpose microprocessors, application specific integrated circuits (ASICs), field programmable gate arrays (FPGAs), or any combination thereof.

Similarly, the land-based production system 12 may include one or more controllers or control systems 38 to monitor and/or control operations of surface equipment 44 and/or downhole equipment (not shown) to extract reservoir fluid from a reservoir 20 via one or more wells 22. As should be appreciated, the surface equipment 44 may include production trees, pipeline manifolds 26, reservoir fluid processing systems, etc., depending on implementation. Moreover, one or more flowlines 28 may generally direct the reservoir fluid from a well 22 to the other surface equipment 44.

As discussed herein, the reservoir fluid extracted from the reservoir 20 may be pressurized with respect to the environment (e.g., atmosphere, subsea, etc.) of the well 22. Moreover, while at least a portion of such pressure may be desired to be maintained (e.g., to motivate flow), the pressure may be greater than desired to continue to the other components of the production system 10, 12. To capitalize on this pressure, a turbine may be disposed (e.g., along one or more flowlines 28) between a well 22 and a lower pressure portion of the production system 10, 12 to produce electrical power and/or drive various equipment. For example, a pressure differential (and fluid flow therebetween) across the turbine may motivate rotation of a turbine rotor, and a generator coupled to the turbine may produce electrical power therefrom. The electrical power produced via the turbine may then be utilized to power one or more portions of the production system 10, 12 or be exported to an electrical grid 46, such as municipal infrastructure.

Figure 2:
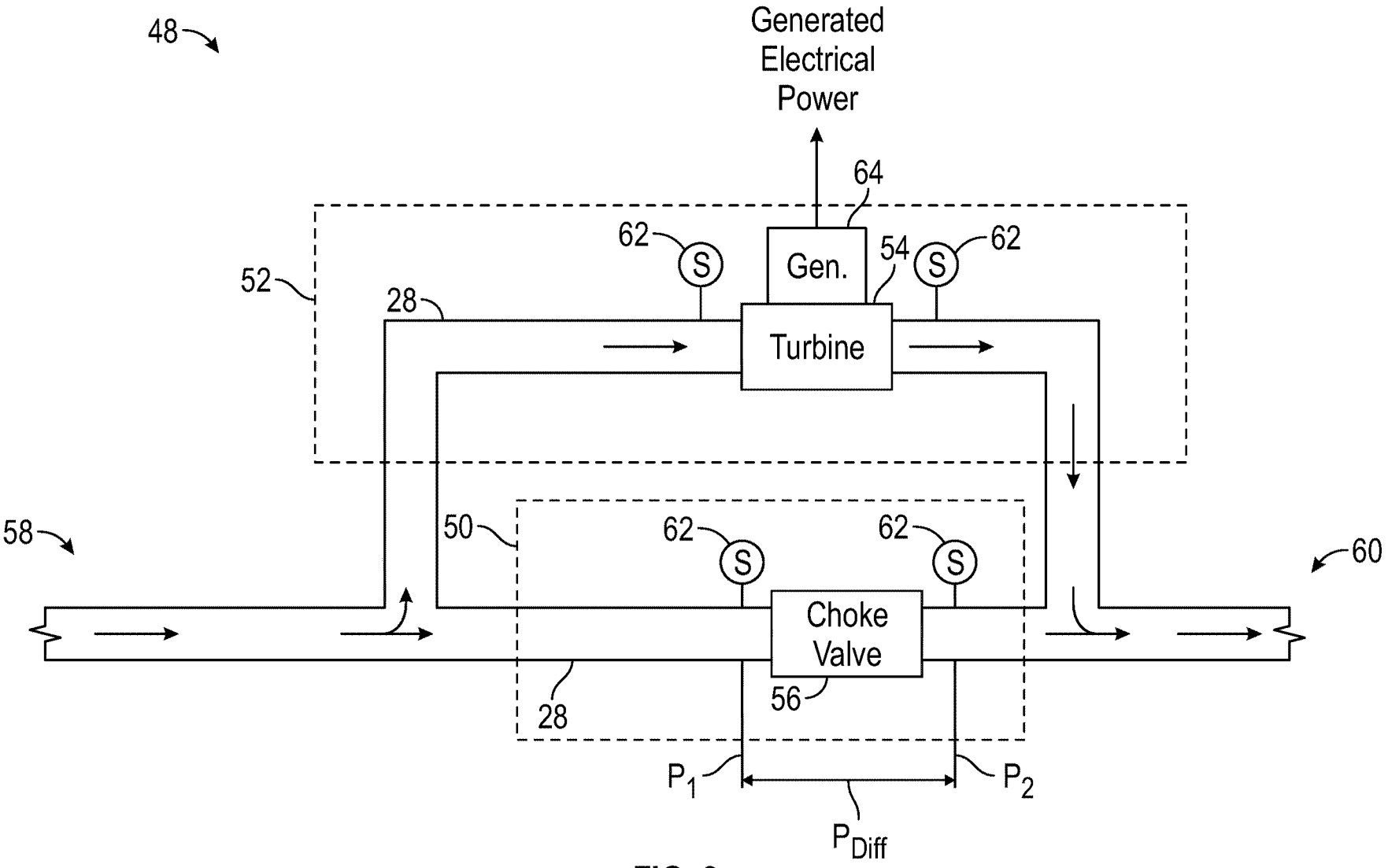
FIG. 2 is a schematic view of a portion of a flowline of FIG. 1, including a primary flow path and a parallel flow path having a turbine, according to an embodiment of the present disclosure.

To help illustrate, FIG. 2 is a schematic view of a portion 48 of a flowline 28, including a primary flow path 50 and a parallel flow path 52 having a turbine 54, according to an embodiment of the present disclosure. As discussed herein, it may be desired to supply reservoir fluid to one or more fluid processing systems (e.g., for refinement, transportation, etc.). However, the pressure of the reservoir fluid from the well 22 may be higher than desired. As such, in some embodiments, a choke valve 56 or other pressure reducing fitment such as an in-line control valve may be disposed along the primary flow path 50 of the flowline 28. The choke valve 56 may provide an adjustable pressure drop between the inlet 58 of the portion 48 of the flowline 28 (e.g., from the well 22) and an outlet 60 of the portion of the flowline 28 (e.g., to fluid processing systems, transportation systems, etc.). For example, a control system 38 may receive feedback from one or more sensors 62 disposed at different locations on the flowline 28 based on which the pressure of the reservoir fluid exiting the primary flow path 50 may be regulated (e.g., via the choke valve 56). The sensors 62 may include pressure sensors, temperature sensors, flow meters, spectral sensors (e.g., to determine a composition of the reservoir fluid), water or moisture sensors, etc. Moreover, the turbine 54 may include one or more sensors 62 therein and/or be utilized to output sensor feedback. For example, the rotation of the turbine 54 may be proportional to the electrical power production therefrom and/or the flow rate of the reservoir fluid. As such, the turbine 54 may have a rotation sensor (e.g., rotations per minute (RPM) sensor) and/or an electrical sensor measuring power output of the turbine 54/generator 64 which may be used to determine the flow rate of the reservoir fluid. Furthermore, the choke valve 56 may be any suitable type of choke valve 56 and may be electronically or manually actuated. Moreover, as should be appreciated, although discussed herein as a choke valve 56, any suitable pressure or flow control valve may be utilized to regulate flow through the primary flow path 50 and/or the parallel flow path 52.

The pressure differential, $P_{Diff}$ (e.g., $P_1$-$P_2$), across the choke valve 56 in the primary flow path 50 likewise causes a pressure differential along the parallel flow path 52. As such, a turbine 54, such as a turboexpander, may be energized due to the flow through the parallel flow path 52 motivated by the pressure differential. The turbine 54 may include an outer casing, a rotor disposed inside the outer casing, one or more bearings (e.g., magnetic bearings), and a plurality of turbine blades coupled to the rotor along an internal flow path (e.g., expanding flow path) through the turbine 54 from an inlet to an outlet. In certain embodiments, the turbine 54 may include one or more stages of the turbine blades. The reservoir fluid flowing along the parallel flow path 52 may flow against and between the turbine blades along the internal flow path to drive rotation of the rotor, thereby generating mechanical energy while expanding and reducing the pressure of the reservoir fluid. Moreover, the mechanical energy of the turbine 54 may be converted to electrical power via a generator 64 mechanically coupled to and rotated by the rotor of the turbine 54. As should be appreciated, any suitable turbine 54 may be utilized to convert the pressure differential into mechanical (and electrical, via the generator 64) energy. For example, in some embodiments, the turbine 54 may be a straight or diagonal inflow turbine with or without a shroud (e.g., for axial pressure balancing). Moreover, the turbine may be hermetically sealed from the reservoir fluid or an in-line, flow through turbine may be used, where the reservoir fluid is able to flow through internal pathways (e.g., for bearing lubrication, cooling, etc.) of the turbine 54. Moreover, while shown as a single turbine 54, in some embodiments, multiple turbines 54 may be disposed in series and/or in parallel (e.g., multiple parallel flow paths 52 and/or multiple turbines 54 in parallel within a single parallel flow path 52) to capture the potential energy of the pressure differential. For example, the pressure differential between the inlet 58 and outlet 60 may be larger than the operating pressure differential of a single turbine 54, and the operating pressure differential of multiple turbines 54 (e.g., in parallel or series) may sum (e.g., according to a series or parallel summation) to the total pressure differential. Additionally, while shown as a turbine 54 with a separate generator coupled thereto, in some embodiments, the generator 64 may be integrated into the turbine 54. For example, a turbine rotor may include magnets or windings such that rotation of the turbine rotor generates electric power without a separate generator 64.

In some scenarios, the turbine 54 may have a desired operating range for the flow rate or pressure differential of the reservoir fluid passing therethrough. In some embodiments, the choke valve 56 may be used to adjust (e.g., based on feedback from the sensors 62) the pressure differential or flow rate to increase the efficiency and/or efficacy of the turbine 54. Moreover, while shown as disposed in the parallel flow path 52, in some embodiments, the turbine 54 may be in series with one or more choke valves 56. As should be appreciated, the portion 48 of the flowline 28 that includes a turbine 54 may be located along any suitable portion of the flowline 28 where a pressure differential is desired or affordable. For example, in some embodiments, the portion 48 of the flowline 28 including the turbine 54 may be disposed in the subsea tree 14, a production tree of the surface equipment 44, a pipeline manifold 26, and/or a surface platform 30 to name a few. Moreover, in some embodiments, the turbine 54 may be located on a skid of the surface equipment 44 or surface platform 30. Furthermore, the turbine 54 may be disposed in any suitable orientation (e.g., horizontally, vertically, or an angle therebetween) depending on implementation.

Additionally, while the turbine 54 provides for power generation when the pressure differential is greater than needed or otherwise desired, in some embodiments, the turbine 54 may be operated as a compressor to provide an increase to the pressure differential between the inlet 58 and outlet 60. In other words, the turbine 54 may operate in a power generation mode or a compressor mode depending on circumstance, and the mode of operation may be set via a control system 38. For example, at early stages of production from a reservoir 20, the pressure from the well 22 may be higher, and the turbine 54 may be used in a power generation mode. Moreover, the pressure may be lower at later stages of production, and the turbine 54 may be used in a compressor mode. As such, the turbine 54 may provide power generation when the pressure differential is higher than desired, and boost the pressure (e.g., using the generator 64 as an electric motor or utilizing a separate electric motor or combustion engine to drive the turbine 54) when the pressure is lower than desired. For example, the turbine 54 may operate as or similar to a turboexpander/compressor, as described in U.S. Pat. No. 9,476,427, which is hereby incorporated by reference.

Figure 3:
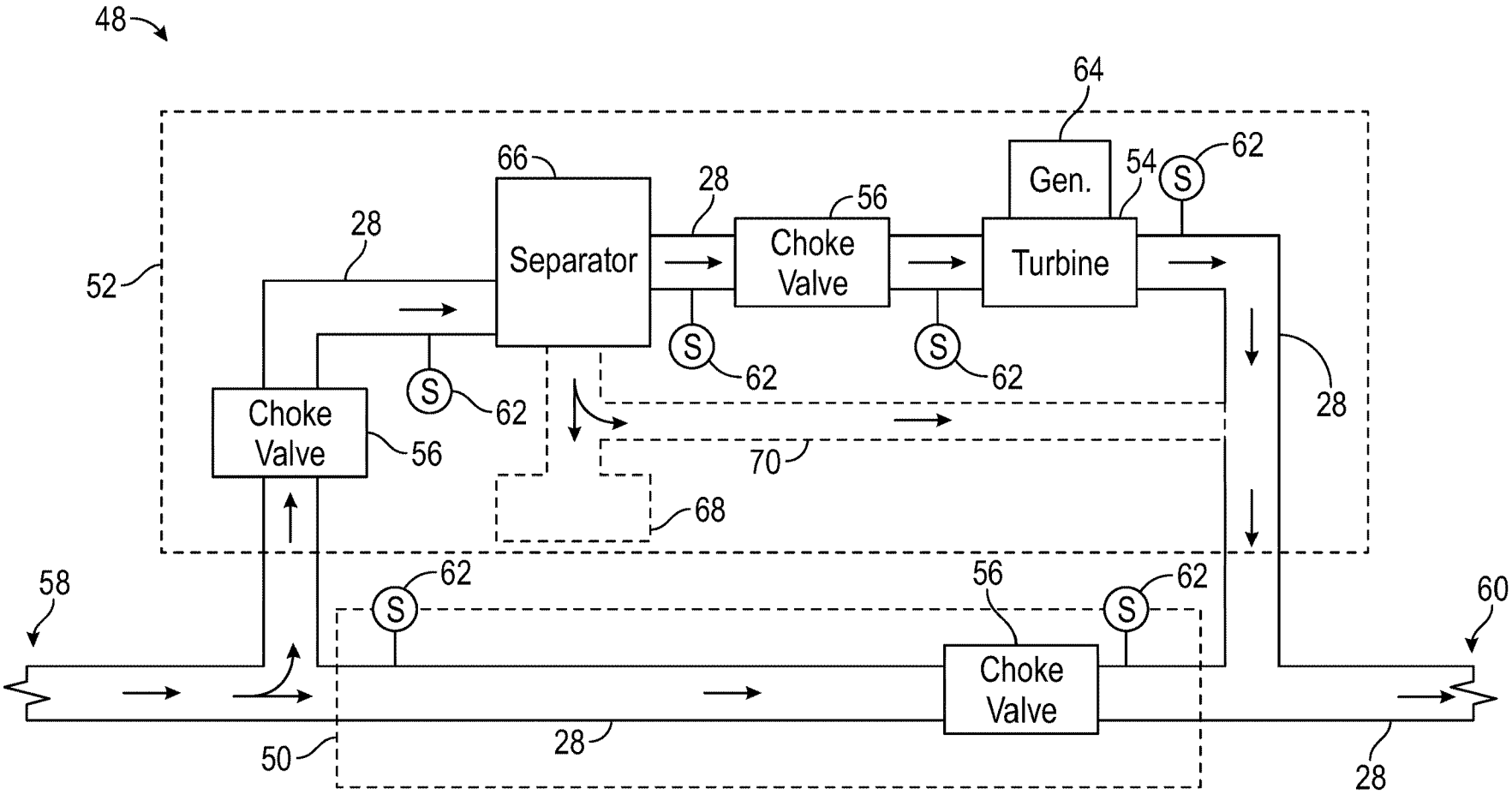
FIG. 3 is a schematic view of the portion of the flowline of FIG. 2 with additional choke valves and a separator in the parallel flow path, according to an embodiment of the present disclosure.

In some embodiments, one or more additional choke valves 56 may be disposed along the parallel flow path 52 to provide for additional control of the pressures and/or flow rates through the primary flow path 50 and parallel flow path 52. For example, as exampled in FIG. 3, one or more choke valves 56 prior to the turbine 54 may allow for independent adjustment of the pressure differential between the inlet 58 and outlet 60 and the operating pressure differential across the turbine 54.

Furthermore, in some embodiments, one or more separators 66 may be disposed prior to the turbine 54 in the parallel flow path 52. The separator 66 may include a gravity separator, a cyclone or centrifugal separator, or a combination thereof. The separator 66 may be a two-phase separator or a three-phase separator. For example, the separator 66 may be configured to separate natural gas, particulate matter, and/or water from oil. In certain embodiments, the separator 66 may separate particulate matter (e.g., sand, rocks, etc.) from the reservoir fluid to reduce the likelihood of wear, such as caused by erosion, on the turbine 54 (e.g., turbine blades, turbine vanes, etc.) and/or other downstream systems. Additionally or alternatively, the separator 66 may separate a gas flow (e.g., natural gas) of the reservoir fluid from a liquid flow (e.g., oil) of the reservoir fluid. For example, the separator 66 may direct a liquid flow of the reservoir fluid to a collection tank 68, and a gas flow may be directed through the turbine 54 such that the turbine 54 receives the gas flow without the liquid flow. Additionally or alternatively, the liquid flow may proceed through a separate turbine 54, be sent to a liquid outlet (e.g., to be processed separately), or proceed via a bypass line 70 that circumvents the turbine 54 (operating via the gas flow) and rejoins the gas flow after the turbine 54. For example, it may be desired that the reservoir fluid composition at the outlet 60 be the same as that of the inlet 58. As discussed herein, the separator 66 may be utilized or excluded from the parallel flow path 52. For example, the composition of the reservoir fluid at the inlet 58 may process through the turbine 54. Moreover, in addition to or instead of one or more separators 66, one or more filters and/or dryers (e.g., heaters) may be utilized to remove or reduce particulate matter and/or water (e.g., liquid or vapor).

Figure 4:
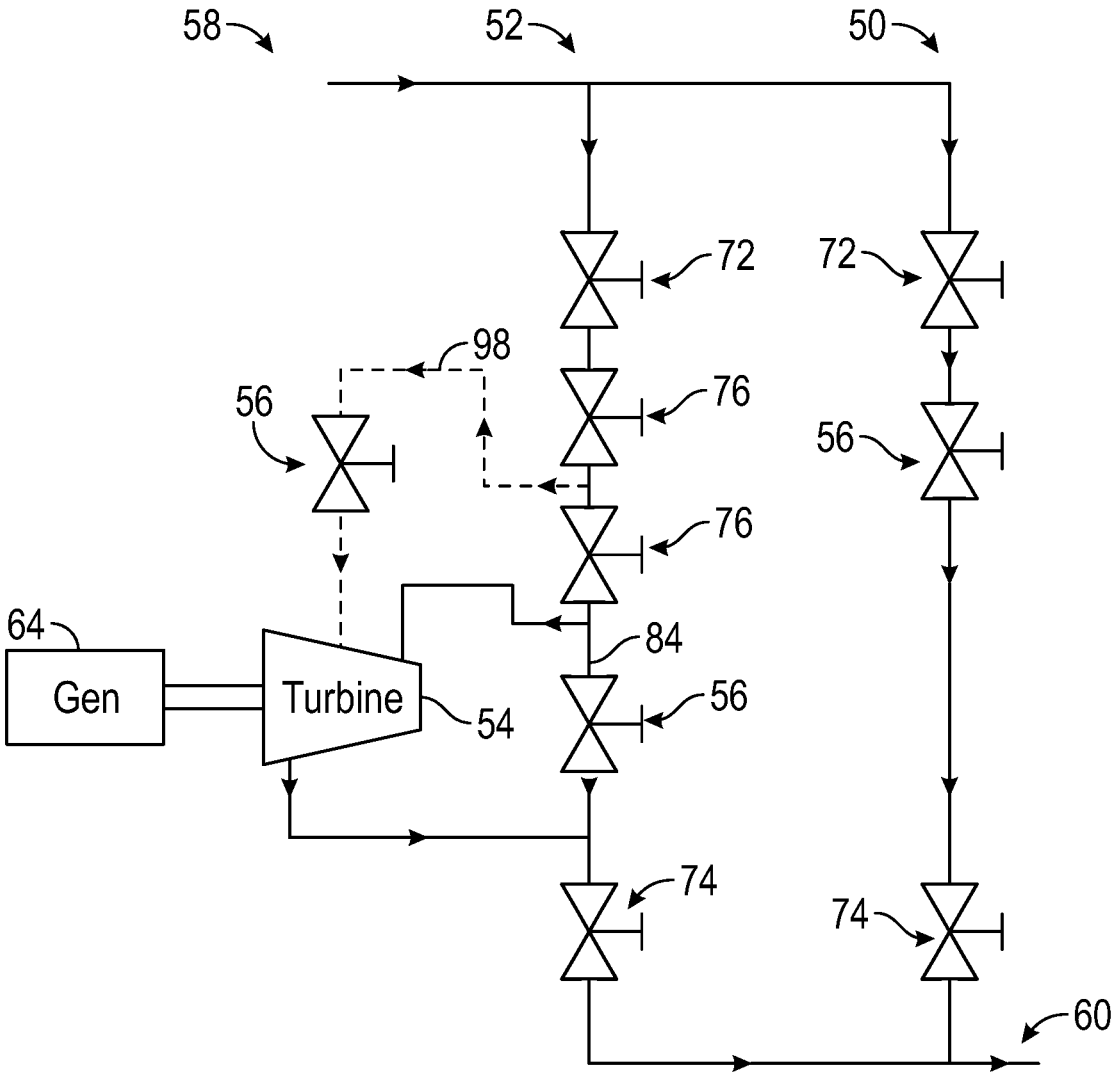
FIG. 4 is a schematic diagram of example valves and placements thereof in relation to the primary flow path and parallel flow path, according to an embodiment of the present disclosure.

FIG. 4 is a schematic diagram of example valve placements (e.g., choke valves 56, shutoff valves 72, isolation valves 74, and/or nozzle valves 76) in relation to the primary flow path 50 and parallel flow path 52, according to an embodiment of the present disclosure. As should be appreciated, while discussed herein as the primary flow path 50, in some scenarios, the flow rate through the primary flow path 50 may greater than, less than, or approximately equal to the flow rate through the parallel flow path 52. Moreover, in some scenarios, 100% of the flow may be directed to either the primary flow path 50 or the parallel flow path 52 by closing a respective shutoff valve 72 and/or isolation valve 74. For example, the primary flow path 50 may be closed during maintenance of the choke valve 56 or to increase the flow rate through the turbine 54. Moreover, the shutoff valve 72 and isolation valve 74 of the parallel flow path 52 may be closed during maintenance of the turbine 54 while maintaining production through the primary flow path 50. As should be appreciated, the shutoff valves 72 and isolation valves 74 may be the same or different, electronically controllable (e.g., via a control system 38) or manually actuated, and may be of any suitable type (e.g., gate valve, ball valve, etc.).

As discussed above, in some scenarios, the reservoir fluid may include particulate matter such as sand that may cause erosion or other damage to the turbine 54. For example, the particulate matter may erode one or more turbine components (e.g., turbine blades, turbine vanes, etc.) along an internal flow path through the turbine 54. As such, in some embodiments, one or more erosion resistance techniques may be implemented to protect the turbine components. While multiple erosion techniques are discussed below, as should be appreciated, each technique may be implemented independently or in conjunction with other techniques. Moreover, each technique may be utilized with any of the previously discussed embodiments.

Figure 5:
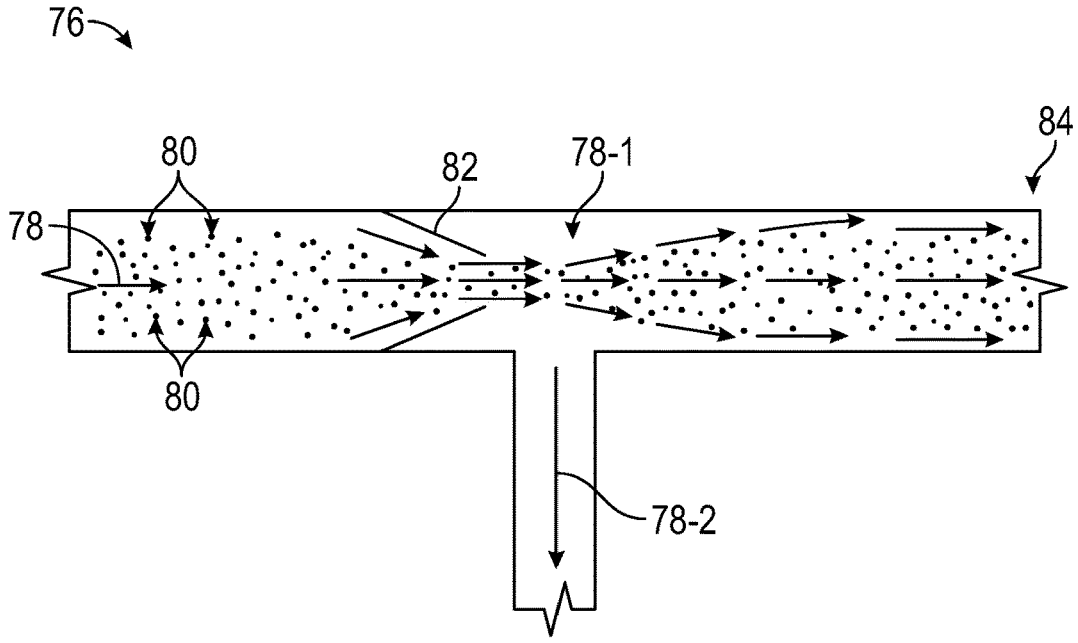
FIG. 5 is a schematic diagram of an example nozzle valve that receives a flow of reservoir fluid that includes particulate matter, according to an embodiment of the present disclosure.

In some embodiments, one or more nozzle valves 76 may be utilized to reduce the amount and/or size of particulate matter to the turbine 54. To help illustrate, FIG. 5 is a schematic diagram of an example nozzle valve 76 that receives a flow 78 of reservoir fluid that includes particulate matter 80, according to an embodiment of the present disclosure. The nozzle valve 76 accelerates the flow 78 of reservoir fluid and particulate matter 80 via a nozzle 82. The nozzle 82 may have a wall (e.g., converging annular wall) disposed about a central axis, wherein the wall gradually converges toward the central axis in the direction of the flow 78. For example, the wall of the nozzle 82 may be a curved annular wall or a frustoconical wall, which converges toward the central axis. The accelerated flow 78-1 (e.g., higher velocity flow) may cause the particulate matter 80 to maintain its momentum in the direction of the nozzle 82, while a clean flow 78-2 is branched off from a lower velocity region (e.g., outer annular area at a diameter greater than an outlet of the nozzle 82) at an angle (e.g., a 90-degree angle, plus or minus 5 or fewer degrees, 10 or fewer degrees, 20 or fewer degrees, or 45 or fewer degrees) with respect to the nozzle 82. Indeed, larger and/or heavier particles (e.g., relative to the average size) of the particulate matter 80 (which may cause more/faster erosion than smaller and/or lighter particles) may follow the direction of accelerated flow 78-1, such as in accordance with the Stokes' Law. As such, a higher concentration (e.g., relative to the average particulate concentration of the incoming flow 78) of particulate matter 80 may be output to a turbine bypass line 84, whereas a clean flow 78-2 (e.g., having a lower concentration of particulate matter 80 relative to the average particulate concentration of the incoming flow 78) is output to the turbine 54, as shown in FIG. 4. In this way, erosion of the turbine 54 may be reduced by reducing the size and/or quantity of particulate matter 80 that flows through the turbine 54.

Additionally, while the nozzle valve 76 provides for separating, at least in part, the particulate matter 80 from the reservoir fluid, the nozzle 82 may also provide for enhanced mixing of the different liquid and/or gas compositions of the reservoir fluid, which may help reduce or prevent slugging in the flowline 28 and/or the turbine 54. Moreover, in some scenarios, the clean flow 78-2 may be at a lower pressure than the incoming flow 78 due to the effect of the nozzle 82. Furthermore, the lowered pressure (if applicable) of the clean flow 78-2 may be further adjusted via a choke valve 56 in the turbine bypass line 84 to set the pressure differential across and/or flow rate through the turbine 54.

Figure 6:
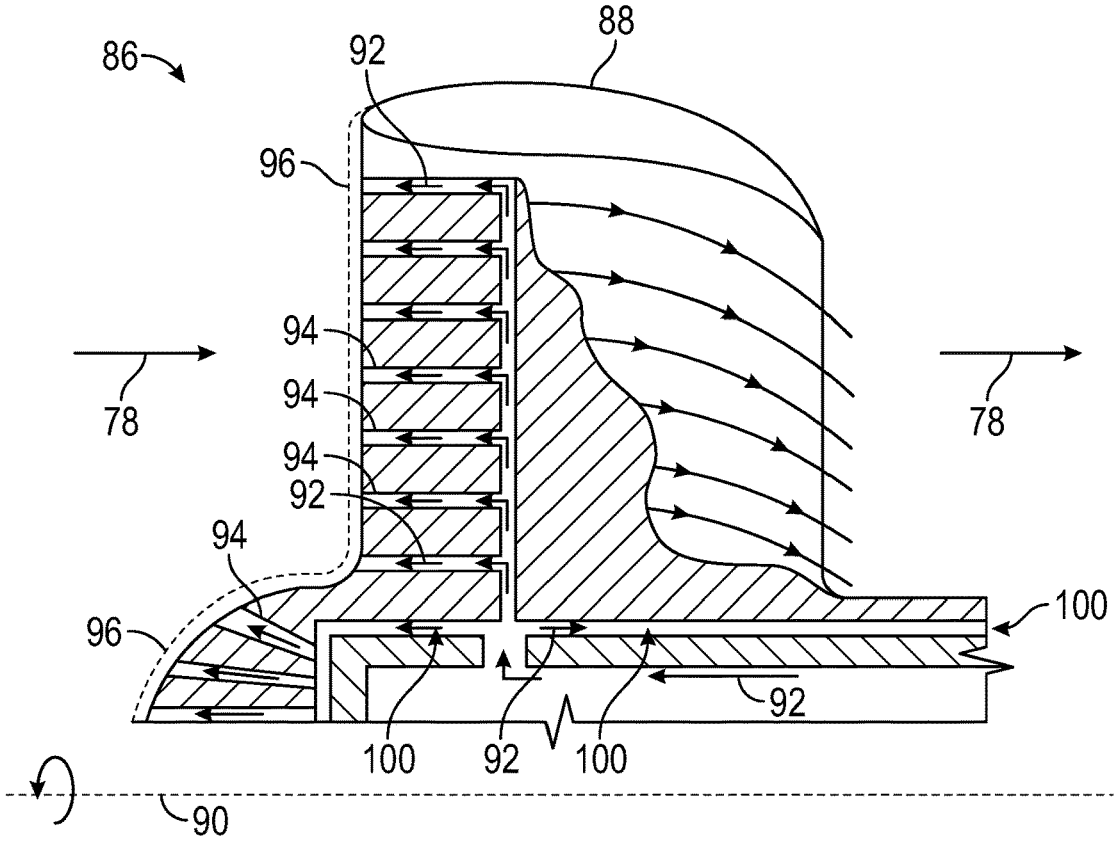
FIG. 6 is a schematic view of a portion of a turbine rotor of the turbine of FIGS. 2-4 including a turbine blade, according to an embodiment of the present disclosure.

Additionally or alternatively, in some embodiments, the turbine 54 itself may include one or more erosion resistance features. For example, FIG. 6 is a schematic view of a portion of a turbine rotor 86 including a turbine blade 88, according to an embodiment of the present disclosure. As the flow 78 (e.g., as from the inlet 58 or clean flow 78-2) passes over the turbine blades 88 (e.g., 2 to 100 turbine blades), it incites a rotation of the turbine rotor 86 about an axis 90, converting the pressure differential to mechanical energy. However, in some scenarios, the flow 78 may include particulate matter 80 that erodes the turbine blades 88. As such, in some embodiments, a secondary flow 92 of formation fluid or other suitable fluid (e.g., compressed air, nitrogen, oil, lubricant, or any clean liquid or gas, etc.) may be excreted from the leading edge of the turbine blades 88 and/or rotor housing through eyelets 94 (e.g., openings, ports, or injection holes) to create a boundary layer 96 that protects, at least partially, the turbine blades 88 and turbine rotor 86 from potential contact with the particulate matter 80. In other words, the turbine rotor 86 produces jets of reservoir fluid in the opposite direction of the flow 78 to generate a boundary layer 96 that protects the turbine rotor 86 from the particulate matter 80. In certain embodiments, the injected fluid may include formation fluid already treated to remove any undesirable particulate, gas, liquid, or the like. As should be appreciated, such jets (e.g., via eyelets 94) may be disposed at any location within the turbine 54 likely to be impacted by particulate matter 80 in the flow 78.

To create the boundary layer 96, the secondary flow 92 may be provided at a higher pressure than the flow 78. For example, in some embodiments, the secondary flow 92 may utilize a separate, secondary flow line 98 (see FIG. 4) tapped from the parallel flow path 52 before the flow 78 to the turbine 54, such as with a choke valve 56 and/or nozzle valve 76 therebetween to create a pressure difference. Moreover, in some embodiments, the secondary flow line 98 may be disposed after a nozzle valve 76 to provide a cleaner secondary flow 92 to the secondary flow line 98, as exampled in FIG. 4. Additionally, in some embodiments, the secondary flow line 98 may have a choke valve 56 that controls the pressure and/or flow rate of the secondary flow 92 to the turbine 54. Moreover, the choke valve 56 in the secondary flow line 98, in conjunction with the choke valve 56 in the turbine bypass line 84, may be utilized to set the difference in pressure between the secondary flow 92 and the flow 78 through the turbine 54 to create or adjust the boundary layer 96.

Additionally or alternatively, the secondary flow 92 may be used to form a fluid bearing 100 of the turbine rotor 86. For example, the secondary flow line 98 may provide positive pressure fluid to act as a barrier and reduce contact between stationary and moving (e.g., rotating) components of the turbine 54, such as the turbine rotor 86. The fluid bearing 100 may reduce resistance (e.g., friction) and/or wear, thus increasing efficiency and/or longevity of the turbine 54. Moreover, in some embodiments, one or more erosion and/or corrosion resistant coatings may be applied to the surfaces of one or more internal components of the turbine 54 (e.g., turbine rotors 86, turbine blades 88, turbine vanes, etc.) to reduce wear. Additionally or alternatively, the components of the turbine 54 may be formed with excess material, such as on leading edge surfaces (e.g., relative to the flow 78 of reservoir fluid), to act as sacrificial material. For example, one or more components of the turbine 54 may be formed using additive manufacturing, and additional material may be deposited during formation to act as sacrificial material. Moreover, potting may be used within the turbine 54 to provide erosion and/or corrosion resistance, such as a potted bearing.

Figure 7:
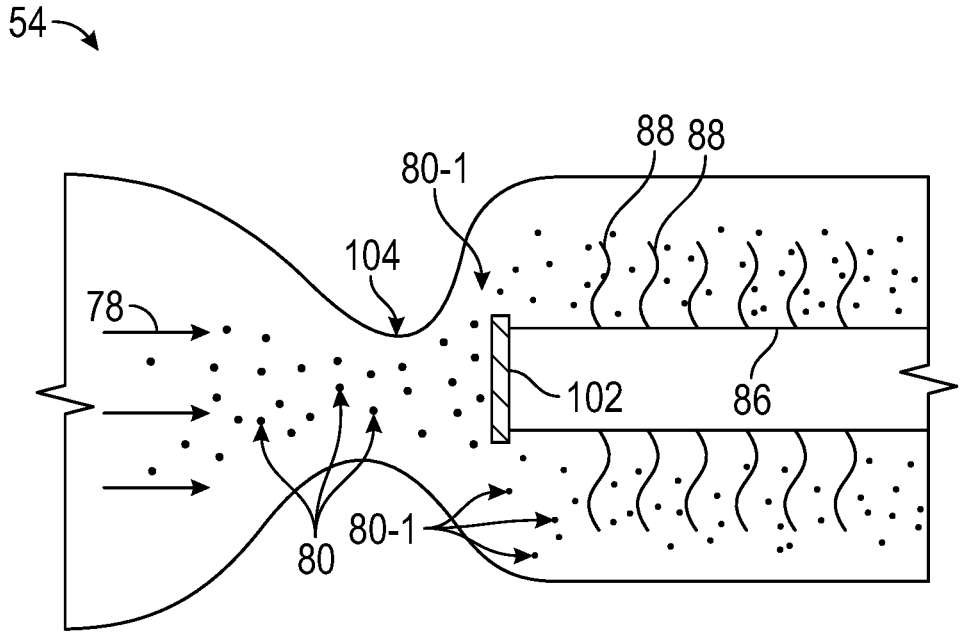
FIG. 7 is a schematic view of a portion of a turbine including a hard target to impact particulate matter, according to an embodiment of the present disclosure.

Additionally or alternatively to using the secondary flow 92 to form a boundary layer 96 or a fluid bearing 100, the turbine 54 may have a hard target 102 disposed on a leading face of the turbine rotor 86 to be impacted by the particulate matter 80, as shown in FIG. 7. In certain embodiments, the hard target 102 may be a flat circular plate made of impact resistant material. However, the hard target 102 may include other shapes and configurations, such as a concave annular plate, a convex annular plate, a textured plate having protrusions and/or recesses. Additionally, the hard target 102 may be stationary (e.g., fixed position) or movable (e.g., rotatable with the turbine rotor 86). The hard target 102 provides a shield or protective wall upon which the particulate matter 80 may break, fracture, and/or lose momentum after impact such that smaller and/or fractured particulate matter 80-1 (e.g., pieces of the particulate matter 80) flows around the turbine blades 88. Indeed, smaller and/or fractured particulate matter 80-1 may have better flow entrainment per Stokes' Law, which may reduce contact with the turbine blades 88 and reduce erosion. Moreover, contact that does occur may be at a lower velocity, as the hard target 102 may slow down the particulate matter 80, 80-1 via the impact. Additionally, the smaller and/or fractured particulate matter 80-1 may cause less erosion and/or break apart further if contact with one or more turbine blades 88 is made. As should be appreciated, the hard target 102 may be made of any suitable impact resistant material (e.g., with a hardness greater than 1000 HV30, greater than 1200HV30, greater than 1500HV30, greater than 1800HV30, and so on) to withstand the impact of the particulate matter 80. For example, the hard target 102 may be composed of diamond, sapphire, a steel alloy, a tungsten alloy, or a combination thereof. Additionally, in some embodiments, a throttling section 104 (e.g., venturi section having a converging annular passage, an annular throat, and a diverging annular passage) may be used to increase the velocity of the flow 78 and particulate matter 80 such that the impact of the particulate matter 80 on the hard target 102 has an increased likelihood of breaking or fracturing the particulate matter 80. For example, the throttling section 104 may include or produce the effect of a nozzle 82 or other fluid directing component. Moreover, the throttling section 104 may focus and direct the particulate matter 80 toward the hard target 102 for an increased likelihood of impact. As should be appreciated, while discussed herein as disposed on the turbine rotor 86, the hard target 102 may be disposed on any suitable surface (e.g., stationary or rotating) to contact the particulate matter 80-1. For example, the hard target 102 may be disposed on the turbine rotor 86 or disposed in the path of the particulate matter 80 prior to the turbine rotor 86.

Figure 8:
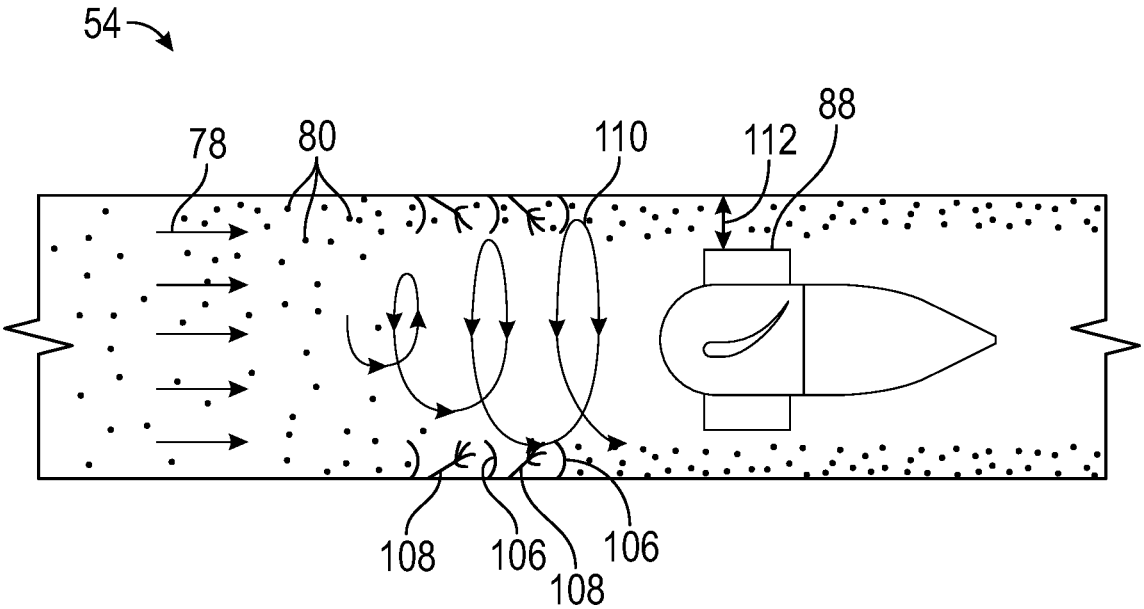
FIG. 8 is a schematic diagram of stators and jets within the turbine or the flowline leading up to the turbine, according to an embodiment of the present disclosure.

Additionally or alternatively, in some embodiments, the flow 78 may be treated to reduce the likelihood that the particulate matter 80 will impact the turbine rotor 86. FIG. 8 is a schematic diagram of stators 106 and jets 108 (e.g., dispensing a portion of secondary flow 92 or other formation fluid flow into the flow 78) within the turbine 54 or the flowline 28 leading up to the turbine 54, according to an embodiment of the present disclosure. In some embodiments, stators 106 and/or jets 108, implemented together or independently, may centrifuge the flow 78 of the reservoir fluid to create a vortex 110 in the flow 78. The vortex 110 slings the particulate matter 80 to the edges of the turbine 54 and/or flowline 28 to reduce the likelihood of the particulate matter 80 impacting the turbine blades 88. Moreover, the clearance 112 between the tips of the turbine blades 88 and the edges of the interior of the turbine 54 may be increased (relative to a clearance 112 in implementations without the vortex 110) so as to allow the particulate concentrated portion of the reservoir flow 78 to pass thereby with reduced impact on the turbine blades 88 and, thus, less erosion. For example, the increased clearance 112 may be greater than 1/16 inch, greater than 1/8 inch, greater than 1/4 inch, greater than 1/2 inch, greater than 1 inch, and so on. In certain embodiments, the clearance 112 between the turbine blades 88 and the interior of the turbine 54 may be adjustable via the control system 38, which may control one or more actuators to adjust the radial position of the turbine blades 88 and/or the inner diameter of the turbine 54. Accordingly, the control system 38 may increase the clearance 112 if amount and/or size of particulate increases in the flow to the turbine 54, or the control system 38 may decrease the clearance 112 if the amount and/or size of the particulate decreases in the flow to the turbine 54. However, in some embodiments, the clearance 112 is fixed at a suitable radial distance to accommodate any expected particulate matter 80 in the flow.

In some scenarios, a vortex 110 in the flow 78 may reduce the efficiency of converting the pressure differential to mechanical energy via the turbine 54. However, by reducing the erosion associated with the flow 78 in the turbine 54 with the vortex 110, the potential loss of operational efficiency may be offset by the increased lifespan and reduced maintenance of the turbine 54 due to the reduced erosion. Furthermore, it is recognized that vortexes 110 may also be undesirable at locations other than such implementations of the turbine 54. For example, a continued vortex 110 may cause erosion in the flowline 28 after the turbine 54. As such, in some embodiments, to reduce or eliminate the vortex 110 after the turbine 54, the flow may be conditioned via, for example, one or more flow straighteners and/or settling plates.

Figure 9:
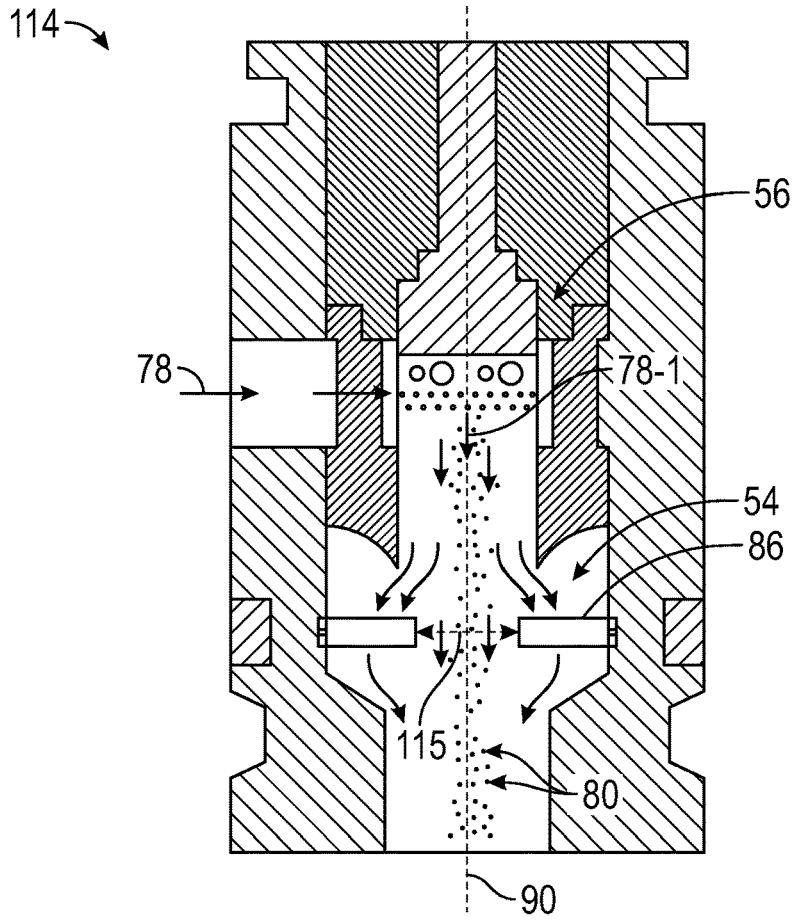
FIG. 9 is a schematic view of an example open center forward flow turbine disposed after a choke valve, according to an embodiment of the present disclosure.

Additionally or alternatively to the erosion resistance techniques discussed above, the turbine 54 may employ an open center design to reduce the likelihood of particulate matter 80 impacting the turbine components (e.g., turbine blades 88 and/or turbine rotor 86). FIG. 9 is a schematic view of an example open center forward flow turbine 114 disposed after a choke valve 56, according to an embodiment of the present disclosure. In a similar manner as the nozzle valve 76 discussed above, a choke valve 56 may provide the flow 78 at an increased velocity (e.g., accelerated flow 78-1) relative to the velocity at the turbine rotor 86 and generally directed toward the center of the flowline 28 and/or turbine 54. As such, a greater concentration of the particulate matter 80, and particularly that of the larger and/or heavier than average particle size, may maintain flow through the center of the open center forward flow turbine 114. However, the turbine rotor 86 and turbine blades 88 (not shown in FIG. 9) of the open center forward flow turbine 114 may be formed as an annulus disposed about the axis 90 such that the majority of the particulate matter 80 passes through the annulus and, thus, has reduced impact on the turbine rotor 86 and/or turbine blades 88. In other words, the turbine rotor 86 may protrude radially inward from the inner sidewall of the turbine 54 such that a circular passage 115 is open within the annulus of the turbine rotor 86. The circular passage 115 allows the portion of the flow 78 having a higher concentration of particulate matter 80 to pass therethrough without impacting the turbine rotor 86. Moreover, a portion of the flow 78 having a lower concentration of particulate matter 80 may flow over the turbine blades 88 of the turbine rotor 86. As should be appreciated, while shown as a plug and cage choke, the choke valve 56 may be of any suitable type. Moreover, the choke valve 56 is shown as an example for providing accelerated flow 78-1, and other devices such as a nozzle 82 or throttling section 104 may be utilized with the open center forward flow turbine 114.

Figure 10:
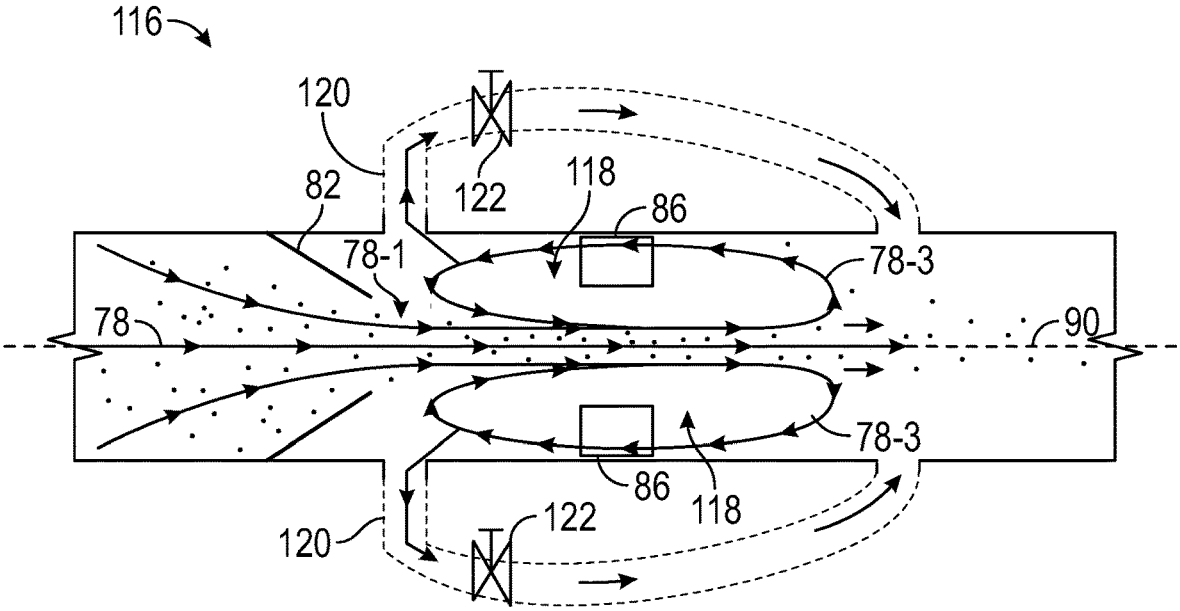
FIG. 10 is a schematic view of an example open center reverse flow turbine disposed after a nozzle, according to an embodiment of the present disclosure.

Furthermore, FIG. 10 is a schematic view of an example open center reverse flow turbine 116 disposed after a nozzle 82, according to an embodiment of the present disclosure. As discussed above, by accelerating the flow 78, the particulate matter 80 may, in the aggregate, remain in a focused portion of the accelerated flow 78-1. As such, the turbine rotor 86 and turbine blades 88 (not shown in FIG. 10) of the open center reverse flow turbine 116 may be formed as an annulus disposed about the axis 90 such that an increased concentration of the particulate matter 80 passes through the annulus and, thus, has reduced impact on the turbine rotor 86 and/or turbine blades 88. Similar to the open center forward flow turbine 114, the turbine rotor 86 may protrude radially inward from the inner sidewall of the turbine 54 such that a circular passage 115 is open within the annulus of the turbine rotor 86 to receive the portion of the flow 78 having a higher concentration of particulate matter 80. However, instead of capturing energy from the flow 78 in the direction of the flow 78 (e.g., as in the open center forward flow turbine 114), the open center reverse flow turbine 116 creates recirculating currents 118 (e.g., eddy currents) that flow in the reverse direction across the turbine blades 88 of the turbine rotor 86. In some scenarios, larger and/or heavier particulate matter 80 may not be recirculated, thereby reducing potential erosion of the turbine components from the reverse flow 78-3. Additionally, in some embodiments, secondary outlets 120 may be used to regulate the magnitude of the reverse flow 78-3. For example, control valves 122 (e.g., choke valves 56 or other flow regulator) may be opened more to increase the flow rate out of the secondary outlets 120, which may increase the magnitude (e.g., velocity and/or flowrate) of the reverse flow 78-3 of the recirculating current 118 and vice versa. In some embodiments, the reservoir fluid output via the secondary outlets 120 may be rejoined further down the flowline 28 or turbine 54. As should be appreciated, the nozzle 82 is shown as an example for providing accelerated flow 78-1 and other devices such as a choke valve 56 or throttling section 104 may be utilized with the open center reverse flow turbine 116.

Figure 11:
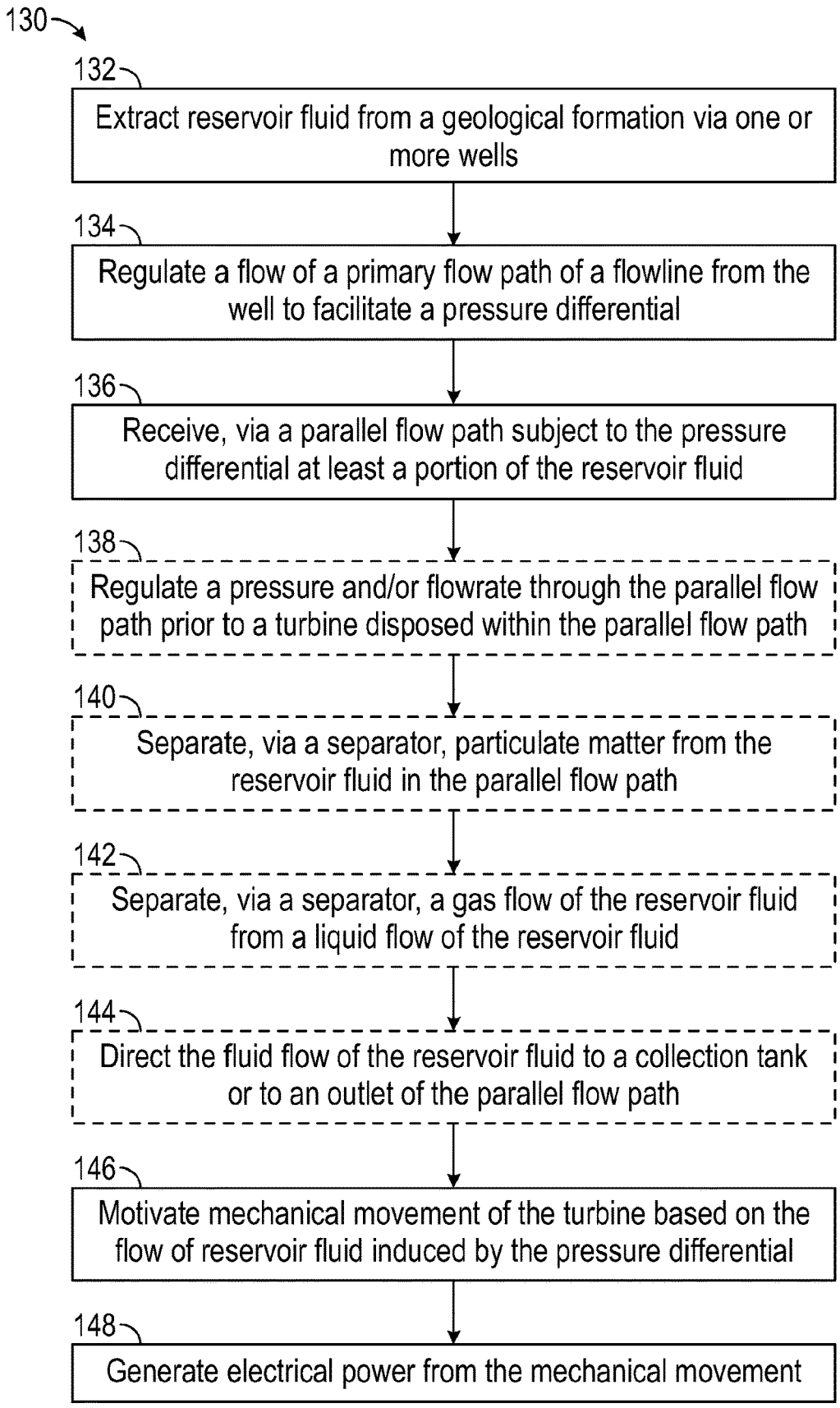
FIG. 11 is a flowchart of an example process for utilizing a turbine to harness the potential energy of a pressure differential in a flowline, according to an embodiment of the present disclosure.

FIG. 11 is a flowchart of an example process 130 for utilizing a turbine 54 to harness the potential energy of the pressure differential in a flowline 28. For example, reservoir fluid may be extracted from a geological formation 24 via one or more wells 22 (process block 132). Additionally, a flow of a primary flow path 50 of a flowline 28 may be regulated (e.g., via a choke valve 56) to facilitate a pressure differential (process block 134). Moreover, a parallel flow path 52, subject to the pressure differential (e.g., between an inlet 58 and an outlet 60 of the primary flow path 50 and parallel flow path 52), may receive at least a portion of the reservoir fluid (process block 136). In some embodiments, the pressure and/or flowrate of the reservoir fluid through the parallel flow path 52 and to a turbine 54 disposed within the parallel flow path 52 may be regulated (process block 138), such as via a choke valve 56. Additionally, in some embodiments, one or more separators 66 may separate particulate matter 80 from the reservoir fluid in the parallel flow path 52 (process block 140) and/or separate a gas flow of the reservoir fluid from a liquid flow of the reservoir fluid (process block 142). As should be appreciated, the same separator 66 may perform both separations or the separator and/or the pressure regulation (e.g., via a choke valve 56) may be omitted entirely from the parallel flow path 52. In embodiments that separate the gas flow from the liquid flow, the liquid flow may be directed to a collection tank or to an outlet 60 of the parallel flow path 52 (process block 144). Additionally, the mechanical movement (e.g., mechanical energy) may be motivated by the flow 78 of the reservoir fluid induced by the pressure differential (process block 146), and the mechanical movement may be utilized (e.g., via a generator 64 or components built into the turbine 54) to generate electrical power (process block 148).

The technical effects of the systems and methods described in the embodiments of FIGS. 1-11 include the utilizing a turbine to harness the potential energy of the pressure differential in a flowline 28. Moreover, techniques to enable the turbine to operate in a particulate laden flow are also discussed herein to reduce the likelihood of erosion within the turbine, increasing lifespan and, therefore efficiency. Furthermore, although the above referenced flowchart is shown in a given order, in certain embodiments, process blocks may be reordered, altered, deleted, and/or occur simultaneously. Additionally, the referenced flowchart is given as an illustrative tool and further decision and process blocks may also be added depending on implementation.

The subject matter described in detail above may be exampled by, but not limited to, one or more embodiments, as set forth below.

EXAMPLE EMBODIMENT 1. A system comprising: a flowline comprising an inlet configured to receive reservoir fluid at a first pressure and an outlet configured to output the reservoir fluid at a second pressure, wherein the flowline comprises a first flow path between the inlet and the outlet and a second flow path between the inlet and the outlet, in parallel with the first flow path, wherein a difference between the first pressure and the second pressure comprises a pressure differential; a valve configured to adjust the pressure differential; and a turbine disposed along the second flow path and configured to generate mechanical energy from a flow of the reservoir fluid induced by the pressure differential, wherein the mechanical energy is converted to electrical energy.

EXAMPLE EMBODIMENT 2. The system of example embodiment 1, wherein the valve comprises a choke valve is disposed along the first flow path.

EXAMPLE EMBODIMENT 3. The system of any of example embodiments 1 and 2, comprising a second valve disposed along the second flow path configured to adjust a flow rate of the reservoir fluid through the turbine.

EXAMPLE EMBODIMENT 4. The system of example embodiment 3, comprising a secondary flow line of the second flow path configured to direct a second flow of the reservoir fluid from the secondary flow line and prior to the second valve to the turbine, wherein the turbine comprises a rotor having a plurality of turbine blades, wherein each turbine blade of the plurality of turbine blades comprises one or more eyelets disposed configured to excrete the second flow, generating a boundary layer in front of each turbine blade, relative to the flow of the reservoir fluid through the turbine, wherein the boundary layer is configured to reduce a frequency, severity, or both of impacts of particulate matter in the reservoir fluid on the plurality of turbine blades.

EXAMPLE EMBODIMENT 5. The system of any of example embodiments 1-4, comprising a separator configured to: reduce an amount of particulate matter in the reservoir fluid; separate a gas flow of the reservoir fluid from a liquid flow of the reservoir fluid, wherein the turbine is configured to receive the gas flow and not the liquid flow; or both.

EXAMPLE EMBODIMENT 6. The system of example embodiment 5, wherein the separator is configured to separate the gas flow from the liquid flow, and wherein the liquid flow is directed to the outlet, bypassing the turbine.

EXAMPLE EMBODIMENT 7. The system of any of example embodiments 1-6, comprising a target disposed in the flow of the reservoir fluid such that particulate matter within the flow impacts the target prior to the flow reaching turbine blades of the turbine.

EXAMPLE EMBODIMENT 8. The system of any of example embodiments 1-7, wherein the reservoir fluid comprises an oil and gas hydrocarbon mixture from a well in a geological formation, and wherein the turbine is configured to receive the reservoir fluid without separation of the oil and gas hydrocarbon mixture via a separator configured to separate a gas flow of the reservoir fluid from a liquid flow of the reservoir fluid.

EXAMPLE EMBODIMENT 9. The system of any of example embodiments 1-8, comprising control circuitry configured to set an operating mode for the turbine from a set of modes, wherein the set of modes comprises a power generation mode and a compressor mode, wherein the turbine is configured to: in response to the mode being the power generation mode, generate the mechanical energy from the flow of the reservoir fluid induced by the pressure differential; and in response to the mode being the compressor mode, generate the pressure differential by motivating the flow of the reservoir fluid.

EXAMPLE EMBODIMENT 10. The system of any of example embodiments 1-9, wherein the turbine comprises a fixed portion and a rotor configured to rotate according to the mechanical energy relative to the fixed portion, the rotor comprising a magnet or windings configured to interface with corresponding windings or a corresponding magnet, respectively, of the fixed portion to convert the mechanical energy to the electrical energy.

EXAMPLE EMBODIMENT 11. A method comprising: receiving, at an inlet of a flowline, a reservoir fluid from a well of a geological formation, wherein the flowline comprises a first flow path between the inlet and an outlet of the flowline and a second flow path between the inlet and the outlet, in parallel with the first flow path; regulating, via a choke valve disposed in the first flow path, a pressure differential of the reservoir fluid between the inlet and the outlet; and generating, via a turbine disposed in the second flow path, power, based on a flow of the reservoir fluid, induced by the pressure differential, through the turbine.

EXAMPLE EMBODIMENT 12. The method of example embodiment 11, comprising adjusting, via a second choke valve disposed along the second flow path, a flow rate of the reservoir fluid through the turbine.

EXAMPLE EMBODIMENT 13. The method of any of example embodiments 11 and 12, comprising separating, via a separator disposed along the second flow path, a gas flow of the reservoir fluid from a liquid flow of the reservoir fluid, wherein the turbine is configured to receive the gas flow and not the liquid flow.

EXAMPLE EMBODIMENT 14. The method of any of example embodiments 11-13, wherein generating the power comprises generating, via a generator mechanically coupled to a shaft of the turbine, electrical power.

EXAMPLE EMBODIMENT 15. The method of any of example embodiments 11-14, comprising generating a vortex in the second flow path such that particulate matter within the reservoir fluid is concentrated along an interior periphery of the flowline and contact between the particulate matter and a rotor of the turbine is reduced.

EXAMPLE EMBODIMENT 16. The method of any of example embodiments 11-15, wherein the turbine comprises a diagonal inflow turbine.

EXAMPLE EMBODIMENT 17. The method of any of example embodiments 11-16, comprising forming at least a portion of the turbine via additive manufacturing.

EXAMPLE EMBODIMENT 18. The method of example embodiment 17, wherein the portion of the turbine is formed with sacrificial material for erosion disposed thereon.

EXAMPLE EMBODIMENT 19. A system comprising: a flowline comprising an inlet, an outlet, a first flow path between the inlet and the outlet, and a second flow path between the inlet and the outlet, in parallel with the first flow path, the flowline configured to receive, at the inlet, a hydrocarbon fluid at a first pressure from a well in a geological formation and output, at the outlet, the hydrocarbon fluid at a second pressure, wherein a difference between the first pressure and the second pressure comprises a pressure differential; a turbine comprising a rotor disposed in the second flow path, the rotor configured to rotate based on a flow of the hydrocarbon fluid through the second flow path, wherein the flow is induced by the pressure differential; and a choke valve disposed on the first flow path and configured to regulate the pressure differential.

EXAMPLE EMBODIMENT 20. The system of example embodiment 19, comprising: one or more sensors disposed in the first flow path, the second flow path, or both and configured to measure a pressure of the hydrocarbon fluid, a temperature of the hydrocarbon fluid, a flow rate of the hydrocarbon fluid, or any combination thereof; and control circuitry configured to control the choke valve to regulate the pressure differential based on feedback from the one or more sensors such that the flow through the second flow path is within an operating envelope of the turbine.

EXAMPLE EMBODIMENT 21. The system of any of example embodiments 19 and 20, comprising a generator coupled to the rotor and configured to generate electric power based on rotation of the rotor.

EXAMPLE EMBODIMENT 22. The system of any of example embodiments 19-21, wherein the hydrocarbon fluid comprises particulate matter, the system comprising a nozzle valve disposed along the second flow path and configured to accelerate, via a nozzle within the nozzle valve, the flow and split the flow into a bypass flow and a turbine flow, wherein the turbine flow is output from the nozzle valve to the turbine after the nozzle and at an angle with respect to a direction of output of the nozzle, wherein the turbine flow comprises a lesser concentration of the particulate matter than the bypass flow.

EXAMPLE EMBODIMENT 23. The system of any of example embodiments 19-22, wherein the turbine comprises an open center turbine and the rotor forms an annulus disposed about an axis such that a portion of the flow is directed through the annulus without contacting blades of the rotor.

EXAMPLE EMBODIMENT 24. The system of any of example embodiments 19-23, wherein the turbine comprises a diagonal inflow turbine.

EXAMPLE EMBODIMENT 25. The system of example embodiment 24, wherein the diagonal inflow turbine a shroud configured to provide axial pressure balancing.

EXAMPLE EMBODIMENT 26. The system of any of example embodiments 24 and 25, wherein a leading edge of a turbine blade of the diagonal inflow turbine is coated is coated with an erosion resistant coating.

EXAMPLE EMBODIMENT 27. The system of any of example embodiments 24-26, wherein one or more portions of the diagonal inflow turbine comprise sacrificial material for erosion.

EXAMPLE EMBODIMENT 28. The system of example embodiment 27, wherein the sacrificial material is additively deposited via additive manufacturing of the one or more portions of the diagonal inflow turbine.

EXAMPLE EMBODIMENT 29. The system of any of example embodiments 24-28, wherein the diagonal inflow turbine comprises a magnetic bearing assembly.

EXAMPLE EMBODIMENT 30. The system of example embodiment 29, wherein the magnetic bearing assembly is potted with a corrosion resistant epoxy for corrosion resistance.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system comprising:

a flowline comprising an inlet configured to receive reservoir fluid at a first pressure and an outlet configured to output the reservoir fluid at a second pressure, wherein the flowline comprises a first flow path between the inlet and the outlet and a second flow path between the inlet and the outlet, in parallel with the first flow path, wherein a difference between the first pressure and the second pressure comprises a pressure differential;

a first valve configured to adjust the pressure differential, wherein the first valve comprises a choke valve disposed along the first flow path;

a turbine disposed along the second flow path and configured to generate mechanical energy from a flow of the reservoir fluid induced by the pressure differential, wherein the mechanical energy is converted to electrical energy;

a second valve disposed along the second flow path configured to adjust a flow rate of the reservoir fluid through the turbine; and a secondary flow line of the second flow path configured to direct a second flow of the reservoir fluid from the secondary flow line and prior to the second valve to the turbine, wherein the turbine comprises a rotor having a plurality of turbine blades, wherein each turbine blade of the plurality of turbine blades comprises one or more eyelets configured to excrete the second flow, generating a boundary layer in front of each turbine blade, relative to the flow of the reservoir fluid through the turbine, wherein the boundary layer is configured to reduce a frequency, severity, or both of impacts of particulate matter in the reservoir fluid on the plurality of turbine blades.

2. The system of claim 1, comprising a separator configured to:

reduce an amount of particulate matter in the reservoir fluid;

separate a gas flow of the reservoir fluid from a liquid flow of the reservoir fluid, wherein the turbine is configured to receive the gas flow and not the liquid flow; or both.

3. The system of claim 2, wherein the separator is configured to separate the gas flow from the liquid flow, and wherein the liquid flow is directed to the outlet, bypassing the turbine.

4. The system of claim 1, comprising a target disposed in the flow of the reservoir fluid such that particulate matter within the flow impacts the target prior to the flow reaching the plurality of turbine blades of the turbine.

5. The system of claim 1, wherein the reservoir fluid comprises an oil and gas hydrocarbon mixture from a well in a geological formation, and wherein the turbine is configured to receive the reservoir fluid without separation of the oil and gas hydrocarbon mixture via a separator configured to separate a gas flow of the reservoir fluid from a liquid flow of the reservoir fluid.

6. The system of claim 1, comprising control circuitry configured to set an operating mode for the turbine from a set of modes, wherein the set of modes comprises a power generation mode and a compressor mode, wherein the turbine is configured to:

in response to the mode being the power generation mode, generate the mechanical energy from the flow of the reservoir fluid induced by the pressure differential; and in response to the mode being the compressor mode, generate the pressure differential by motivating the flow of the reservoir fluid.

7. The system of claim 1, wherein the turbine comprises a fixed portion and the rotor configured to rotate according to the mechanical energy relative to the fixed portion, the rotor comprising a magnet or windings configured to interface with corresponding windings or a corresponding magnet, respectively, of the fixed portion to convert the mechanical energy to the electrical energy.

8. A method comprising:

receiving, at an inlet of a flowline, a reservoir fluid from a well of a geological formation, wherein the flowline comprises a first flow path between the inlet and an outlet of the flowline and a second flow path between the inlet and the outlet, in parallel with the first flow path;

regulating, via a choke valve disposed in the first flow path, a pressure differential of the reservoir fluid between the inlet and the outlet; and generating, via a turbine disposed in the second flow path, power, based on a flow of the reservoir fluid, induced by the pressure differential, through the turbine, wherein generating the power comprises generating, via a generator mechanically coupled to a rotor of the turbine, electrical power;

adjusting, via a second choke valve disposed along the second flow path, a flow rate of the reservoir fluid through the turbine; and directing a second flow from a secondary flow line of the second flow path and prior to the second choke valve to the turbine, wherein the rotor of the turbine comprises a plurality of turbine blades, wherein each turbine blade of the plurality of turbine blades comprises one or more eyelets;

excreting the second flow from the one or more eyelets of each blade of the plurality of turbine blades, thereby generating a boundary layer in front of each turbine blade, relative to the flow of the reservoir fluid through the turbine, wherein the boundary layer is configured to reduce a frequency, severity, or both of impacts of particulate matter in the reservoir fluid on the plurality of turbine blades.

9. The method of claim 8, comprising separating, via a separator disposed along the second flow path, a gas flow of the reservoir fluid from a liquid flow of the reservoir fluid, wherein the turbine is configured to receive the gas flow and not the liquid flow.

10. The method of claim 8, comprising generating a vortex in the second flow path such that the particulate matter within the reservoir fluid is concentrated along an interior periphery of the flowline and contact between the particulate matter and the rotor of the turbine is reduced.

11. A system comprising:

a flowline comprising an inlet, an outlet, a first flow path between the inlet and the outlet, and a second flow path between the inlet and the outlet, in parallel with the first flow path, the flowline configured to receive, at the inlet, a hydrocarbon fluid at a first pressure from a well in a geological formation and output, at the outlet, the hydrocarbon fluid at a second pressure, wherein a difference between the first pressure and the second pressure comprises a pressure differential, and wherein the hydrocarbon fluid comprises particulate matter;

a turbine comprising a rotor disposed in the second flow path, the rotor configured to rotate based on a flow of the hydrocarbon fluid through the second flow path, wherein the flow is induced by the pressure differential;

a choke valve disposed on the first flow path and configured to regulate the pressure differential; and a nozzle valve disposed along the second flow path and configured to accelerate, via a nozzle within the nozzle valve, the flow and split the flow into a bypass flow and a turbine flow, wherein the turbine flow is output from the nozzle valve to the turbine after the nozzle and at an angle with respect to a direction of output of the nozzle, wherein the turbine flow comprises a lesser concentration of the particulate matter than the bypass flow.

12. The system of claim 11, comprising:

one or more sensors disposed in the first flow path, the second flow path, or both and configured to measure a pressure of the hydrocarbon fluid, a temperature of the hydrocarbon fluid, a flow rate of the hydrocarbon fluid, or any combination thereof; and control circuitry configured to control the choke valve to regulate the pressure differential based on feedback from the one or more sensors such that the flow through the second flow path is within an operating envelope of the turbine.

13. The system of claim 11, comprising a generator coupled to the rotor and configured to generate electric power based on rotation of the rotor.

14. The system of claim 11, wherein the turbine comprises an open center turbine and the rotor forms an annulus disposed about an axis such that a portion of the flow is directed through the annulus without contacting blades of the rotor.

* * * * *